US008686926B2

(12) United States Patent
Han et al.

(10) Patent No.: US 8,686,926 B2
(45) Date of Patent: Apr. 1, 2014

(54) ORGANIC LIGHT EMITTING DISPLAY DEVICE AND PIXEL CIRCUIT

(75) Inventors: Sam-Il Han, Yongin (KR); Jin-Tae Jeong, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 528 days.

(21) Appl. No.: 12/967,371

(22) Filed: Dec. 14, 2010

(65) Prior Publication Data

US 2012/0001896 A1 Jan. 5, 2012

(30) Foreign Application Priority Data

Jun. 30, 2010 (KR) ..... 10-2010-0062764

(51) Int. Cl.
*G09G 3/30* (2006.01)
*G09G 3/32* (2006.01)

(52) U.S. Cl.
USPC ..... 345/76; 345/82

(58) Field of Classification Search
USPC ..... 345/82, 76, 77, 78
See application file for complete search history.

(56) References Cited

U.S. PATENT DOCUMENTS

| | | | | |
|---|---|---|---|---|
| 2003/0112205 | A1 | 6/2003 | Yamada | |
| 2005/0285825 | A1 | 12/2005 | Eom et al. | |
| 2006/0066532 | A1 | 3/2006 | Jeong | |
| 2007/0132694 | A1 * | 6/2007 | Uchino et al. | 345/92 |
| 2010/0013816 | A1 * | 1/2010 | Kwak | 345/211 |
| 2010/0079361 | A1 | 4/2010 | Lee et al. | |
| 2010/0149160 | A1 | 6/2010 | Kimura | |

FOREIGN PATENT DOCUMENTS

| | | | |
|---|---|---|---|
| EP | 1 496 495 | A2 | 1/2005 |
| JP | 2009-175716 | | 8/2009 |
| KR | 10-2005-0052033 | A | 6/2005 |
| KR | 10-2006-0019757 | | 3/2006 |
| KR | 10-2009-0005588 | A | 1/2009 |
| KR | 10-2009-0042006 | A | 4/2009 |
| KR | 10-2009-0106162 | A | 10/2009 |
| KR | 10-2010-0009219 | A | 1/2010 |
| KR | 10-2010-0064621 | | 6/2010 |

OTHER PUBLICATIONS

U.S. Appl. No. 12/941,380, filed Nov. 8, 2010, Jin-Tae Jeong, et al., Assignee Samsung Mobile Display Co., Ltd.

(Continued)

*Primary Examiner* — Chanh Nguyen
*Assistant Examiner* — John Kirkpatrick
(74) *Attorney, Agent, or Firm* — Christie, Parker & Hale, LLP

(57) ABSTRACT

A pixel includes an OLED between a first power supply and a second power supply; a first transistor between the first power supply and the OLED, in which a gate electrode is connected to a first node; a second transistor between a first electrode of the first transistor and a data line, in which a gate electrode is connected to a current scanning line; a third transistor between a second electrode of the first transistor and the first node, in which a gate electrode is connected to the current scanning line or a control line; a fourth transistor between the second electrode of the first transistor and the OLED, in which a gate electrode is connected to a light emitting control line; and a fifth transistor between a connecting node of the fourth transistor and the OLED and the second power supply or a third power supply.

14 Claims, 12 Drawing Sheets

(56) References Cited

OTHER PUBLICATIONS

KIPO Notice of Allowance dated May 22, 2012, for Korean Patent application 10-2010-0062763, (1 page).
KIPO Office action dated Nov. 8, 2011, for Korean priority Patent application 10-2010-0062764, noting Korean reference previously filed in an IDS dated Dec. 14, 2010, 4 pages.
European Patent Office action dated Sep. 9, 2011, for European Patent application 11171705.4, corresponding to cross reference U.S. Appl. No. 12/941,380, 9 pages.
KIPO Office action dated Apr. 30, 2012, for Korean priority Patent application 10-2010-0062764, (1 page).
KIPO Office action dated Nov. 8, 2011, for Korean Patent application 10-2010-0062763, (4 pages).

* cited by examiner

ORGANIC LIGHT EMITTING DISPLAY DEVICE AND PIXEL CIRCUIT

CROSS-REFERENCE TO RELATED APPLICATION

This application claims priority to and the benefit of Korean Patent Application No. 10-2010-0062764, filed on Jun. 30, 2010, in the Korean Intellectual Property Office, the disclosure of which is incorporated herein by reference.

BACKGROUND

1. Field

An embodiment of the present invention relates to a pixel and an organic light emitting display device using the same, and more particularly, to an organic light emitting display device using a pixel that has an improved response time.

2. Description of the Related Art

Currently, all sorts of flat panel display devices are being developed, of which flat panel display devices have a lighter weight and a smaller volume as compared to a cathode ray tube.

Especially, an organic light emitting display device among the flat panel display devices is receiving much attention as the next generation display device because the organic light emitting display device has excellent luminance and color purity when displaying an image. The is because the organic light emitting display device uses an organic light emitting diode which is a self-emitting device.

The above-mentioned organic light emitting display device may be divided into a passive matrix organic light emitting display device (PMOLED) and an active matrix organic light emitting display device (AMOLED) according to a way for driving an organic light emitting diode.

The active matrix organic light emitting display device among these includes a plurality of pixels arranged at the intersection between scanning lines and data lines. In addition, each pixel includes the organic light emitting diode and a pixel circuit for driving the organic light emitting diode. The pixel circuit is typically composed of a switching transistor, a driving transistor, and a storage capacitor.

The active matrix organic light emitting display device may be useful in a portable display device, and the like, because of its low electric power consumption.

However, for the active matrix organic light emitting display device, it is possible that the response time is decreased due to a hysteresis of the driving transistor. In other words, when pixels display a white after displaying a black over many frames, it is possible that the response time is decreased. This is because of a continuous off-voltage supplied to the driving transistor during the period for displaying a black, a transistor curve is shifted, and then a target luminance value is not expressed sufficiently at the initial period for displaying a white.

SUMMARY

An aspect of the present invention is to provide a pixel having an improved response time and an organic light emitting display device using the same.

According to one aspect of the present invention, there is provided a pixel which includes an organic light emitting diode connected between a first power supply that is a high potential pixel power supply and a second power supply that is a low potential pixel power supply; a first transistor that is connected between the first power supply and the organic light emitting diode, in which a gate electrode is connected to a first node; a second transistor that is connected between a first electrode of the first transistor connected to the first power supply and a data line, in which a gate electrode is connected to a present scanning line; a third transistor that is connected between a second electrode of the first transistor connected to the organic light emitting diode and the first node, in which a gate electrode is connected to the present scanning line or a control line; a fourth transistor that is connected between the second electrode of the first transistor and the organic light emitting diode, in which a gate electrode is connected to a light emitting control line, a fifth transistor that is connected between a connecting node of the fourth transistor and the organic light emitting diode, and the second power supply or a third power supply that is an initialization power supply, in which a gate electrode is connected to a previous scanning line or the control line; and a storage capacitor that is connected between the first power supply and the first node.

According to another aspect of the present invention, the pixel further includes a sixth transistor that is connected between the first electrode of the fifth transistor connected to the connecting node of the fourth transistor and the organic light emitting diode, and the first node, wherein the gate electrode of the fifth transistor and the sixth transistor is mutually connected to the previous scanning line.

According to another aspect of the present invention, the fifth transistor and the sixth transistor are turned on during an initialization period for supplying a previous scanning signal to the previous scanning line, so that voltage of the second power supply or the third power supply is applied to the first node; and the fourth transistor is turned on by a light emitting control signal that is supplied to the light emitting control line during a first period among the initialization period.

According to another aspect of the present invention, a current path that flows from the first power supply to the second power supply or the third power supply via the first transistor, the fourth transistor and the fifth transistor is formed during the first period among the initialization period.

According to another aspect of the present invention, the fourth transistor is turned off by the light emitting control signal during a second period after the first period among the initialization period.

According to another aspect of the present invention, the pixel further includes a seventh transistor that is connected between the first electrode of the first transistor and the first power supply, wherein a gate electrode is connected to the light emitting control line.

According to another aspect of the present invention, the pixel further includes a boosting capacitor that is connected between the present scanning line and the first node.

According to another aspect of the present invention, the gate electrode of the third transistor and the fifth transistor are mutually connected to the control line.

According to another aspect of the present invention, the third transistor and the fifth transistor is turned on by the control signal that is supplied from the control line during the first period that is the initialization period and the second period after the first period; the fourth transistor is turned on by the light emitting control signal that is supplied from the light emitting control line during the first period, and then is turned off by the light emitting control signal having a changed voltage level during the second period; and the second transistor is maintained in a turn-off state during an initial period of the second period along with the first period, and then is turned on by the present scanning signal that is supplied from the present scanning signal during the second period.

According to another aspect of the present invention, the current path that flows from the first power supply to the third power supply or the second power supply via the first transistor, the fourth transistor and the fifth transistor is formed during the first period, and voltage of the second power supply or the third power supply is applied to the first node via the third transistor, the fourth transistor and the fifth transistor.

According to another aspect of the present invention, there is provided an organic light emitting display device which includes: a scanning driver that sequentially supplies a scanning signal to scanning lines and supplies a light emitting control signal to light emitting control lines that are aligned with the scanning lines; a data driver that supplies a data signal to data lines; a pixel unit that is arranged at the intersection of the scanning lines, the light emitting control lines and the data lines, and includes a plurality of pixels that are supplied with a first power, a high potential pixel power and a second power, a low potential pixel power; in which the pixels include respectively: an organic light emitting diode that is connected between a first power supply and a second power supply; a first transistor that is connected between the first power supply and the organic light emitting diode, in which a gate electrode is connected to a first node; a second transistor that is connected between a first electrode of the first transistor connected to the first power supply and a data line, in which a gate electrode is connected to a present scanning line; a third transistor that is connected between a second electrode of the first transistor connected to the organic light emitting diode and the first node, in which a gate electrode is connected to the present scanning line or a control line; a fourth transistor that is connected between the second electrode of the first transistor and the organic light emitting diode, in which a gate electrode is connected to a light emitting control line, a fifth transistor that is connected between a connecting node of the fourth transistor and the organic light emitting diode, and the second power supply or a third power supply that is an initialization power supply, in which a gate electrode is connected to a previous scanning line or the control line; and a storage capacitor that is connected between the first power supply and the first node.

According to another aspect of the present invention, each pixel further includes a sixth transistor that is connected between the first electrode of the fifth transistor connected to the connecting node of the fourth transistor and the organic light emitting diode, and the first node, wherein the gate electrode of the fifth transistor and the sixth transistor is mutually connected to the previous scanning line.

According to another aspect of the present invention, the scanning driver supplies a light emitting control signal that can turn on the fourth transistor to the light emitting control line during a first period among the period for supplying a previous scanning signal to the previous scanning line.

According to another aspect of the present invention, the scanning driver supplies the light emitting control signal that can turn off the fourth transistor to the light emitting control line during a second period after the first period among the period for supplying the previous scanning signal to the previous scanning line.

According to another aspect of the present invention, the scanning driver continuously supplies the light emitting control signal that can turn off the fourth transistor to the light emitting control line during the period from the second period after the first period to a third period for supplying the present scanning signal to the present scanning line among the period for supplying the previous scanning signal, and then supplies the light emitting control signal that can turn on the fourth transistor to the light emitting control line during a fourth period after the third period.

According to another aspect of the present invention, the organic light emitting display device further includes control lines that are aligned with the scanning lines and connected to the gate electrode of the third and the fifth transistors included in the pixels, and a control line driver that sequentially supplies a control signal to the control lines.

According to another aspect of the present invention, the control line driver supplies a control signal that can turn on the third and the fifth transistors to a control line connected to the pixels during the period from the first period before supplying the present scanning signal to the present scanning line to the second period after the first period, and then supplies the control signal that can turn off the third and the fifth transistors to the control line after completely supplying the present scanning signal.

According to another aspect of the present invention, the scanning driver supplies the scanning signal that can turn on the second transistor to the present scanning line during the second period, and supplies the control signal that can turn on the fourth transistor and the light emitting control signal that can turn off the fourth transistor to the light emitting control line during the first period and the second period, respectively, and then supplies the light emitting control signal that can turn on the fourth transistor during a third period after completing the second period.

According to another aspect of the present invention, the current path, flows to the low potential pixel power supply or the initialization power supply from the high potential pixel power supply via the driver transistor and the fifth transistor connected in a parallel to the organic light emitting diode, is formed during the initialization period before supplying the data signal into the pixels, so that the problem related to the decrease of the response time due to the hysteresis of the driving transistor can be improved.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and/or advantages of the invention will become apparent and more readily appreciated from the following description of the embodiments, taken in conjunction with the accompanying drawings of which.

DETAILED DESCRIPTION

Figure 1:
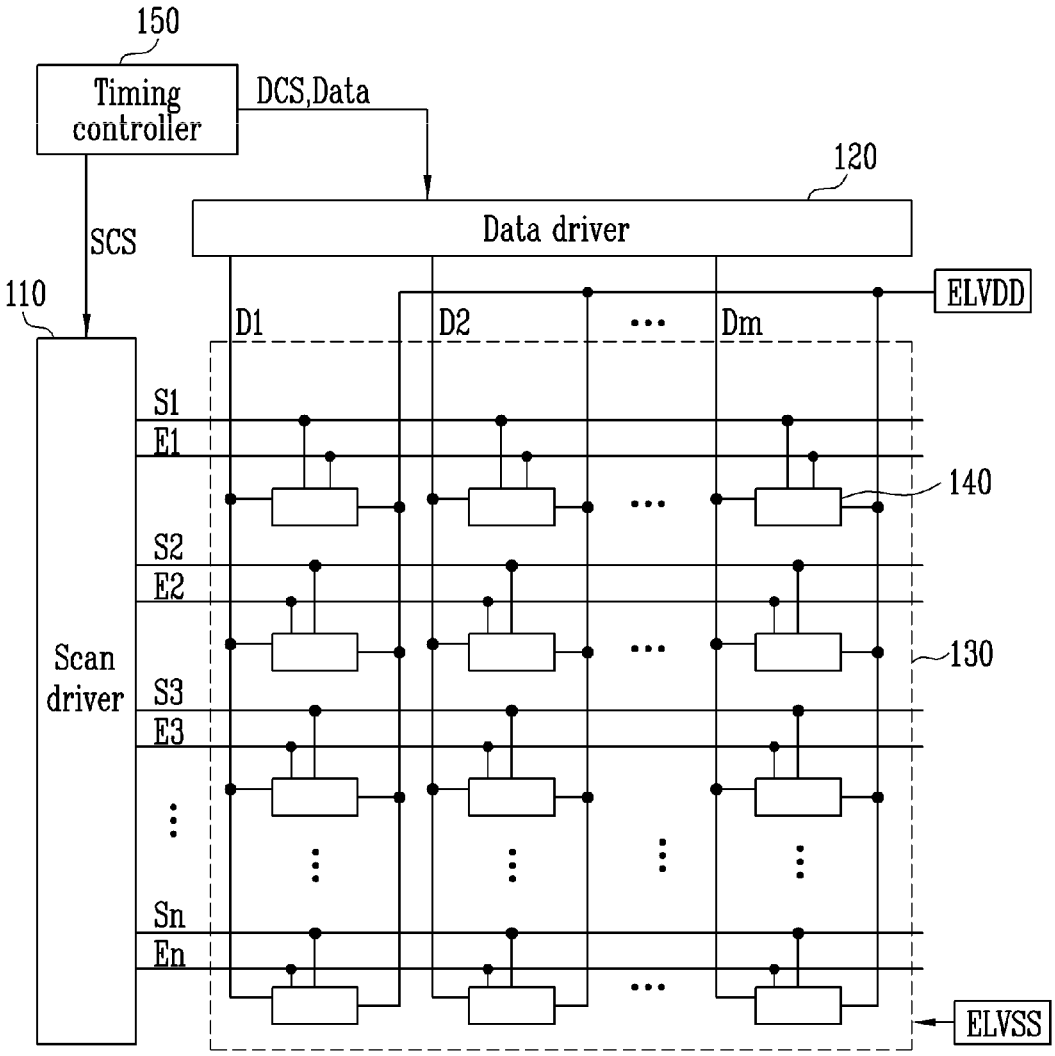
FIG. 1 is a block view roughly showing an organic light emitting display device according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 is a block view roughly showing an organic light emitting display device according to an embodiment of the present invention. Referring to FIG. 1, an organic light emitting display device according to an embodiment of the present invention includes a pixel unit 130 including a plurality of pixels arranged at the intersection of scanning lines S1 to Sn, light emitting control lines E1 to En and data lines D1 to Dm, a scan or scanning driver 110 to drive the scanning lines S1 to Sn and the light emitting control lines E1 to En, a data driver 120 to drive the data lines D1 to Dm, and a timing controller 150 to control the scanning driver 110 and the data driver 120.

The scanning driver 110 is supplied with a scanning driving control signal (SCS) from the timing controller 150. The scanning driver 110 supplied with the scanning driving control signal (SCS) generates a scanning signal, and then sequentially supplies the generated scanning signal to the scanning lines S1 to Sn.

In addition, the scanning driver 110 supplies the light emitting control signal to the light emitting control lines E1 to En that are aligned with the scanning lines S1 to Sn, corresponding to the scanning driving control signal (SCS).

However, the scanning driver 110 sequentially supplies the scanning signal to the scanning lines S1 to Sn, in which the scanning signal allows fixed transistors (not shown) that are included in the pixels 140 to be turned on. But, the scanning driver 110 supplies the light emitting control signal to the light emitting control lines E1 to En, in which the light emitting control signal allows the fixed transistors that are included in the pixels 140, at the initial period (first period) among the period for supplying a previous scanning signal to a previous scanning line on each pixel 140 basis.

Thereafter, the scanning driver 110 continuously supplies the light emitting control signal that allows the fixed transistors in the pixels to be turned on from a second period after the first period among the period for supplying the previous scanning signal to a third period for supplying the present scanning signal to the present scanning line. After completely supplying the present scanning signal, the scanning driver 110 supplies the light emitting control signal that allows the fixed transistors to be turned on.

Meanwhile, for convenience, FIG. 1 shows that one scanning driver 110 generates and outputs all of the scanning signals and the light emitting control signals, but the aspects of the present invention are not limited thereto.

In other words, a plurality of scanning drivers 110 may supply the scanning signals and the light emitting control signals from both sides of the pixel unit 130. Alternatively, a driving circuit that generates and outputs the light emitting control signals and a driving circuit that generates and outputs the scanning signals may be separated and formed as distinct driving circuits, and these circuits may be called the scanning driver and the light emitting control driver, respectively. In this configuration, the scanning driver and the light emitting control driver may be formed on a same side of the pixel unit 130, or may be formed on opposite sides of the pixel unit 130.

The data driver 120 is supplied with a data driving control signal (DCS) from the timing controller 150. The data driver 120 supplied with the data driving control signal (DCS) generates a data signal corresponding to the DCS, and then supplies the generated data signal to the data lines D1 to Dm.

The timing controller 150 generates the data driving control signal (DCS) and the scanning driving control signal (SCS), corresponding to synchronizing signals supplied from the outside. The data driving control signal generated in the timing controller 150 is supplied to the data driver 120, and the scanning driving control signal (SCS) is supplied to the scanning driver 110. In addition, the timing controller 150 supplies the data supplied from the outside to the data driver 120.

The pixel unit 130 is supplied with a first power (ELVDD), supplied by a first power supply, as a high potential pixel power and a second power (ELVSS), supplied by a second power supply, as a low potential pixel power from the outside and then supplies the powers to each pixel 140, respectively. Each pixel 140 supplied with the first power (ELVDD) and the second power (ELVSS) generates light corresponding to the data signals. In addition, the pixel unit 130 may be further supplied with a third power, such as an initialization power according to the configuration of the pixels 140, and then may supply the third power to each pixel 140.

Meanwhile, FIG. 1 only shows that the pixels 140 are connected to one scanning line, i.e., the current scanning line, but the pixels 140 according to aspects of the present invention can be connected to two scanning lines. For example, the pixel 140 arranged at an i-th (here, i is a natural number) horizontal line may be connected to i-th scanning line Si as the current scanning line and i−1 scanning line Si−1 as the previous scanning line.

Figure 2:
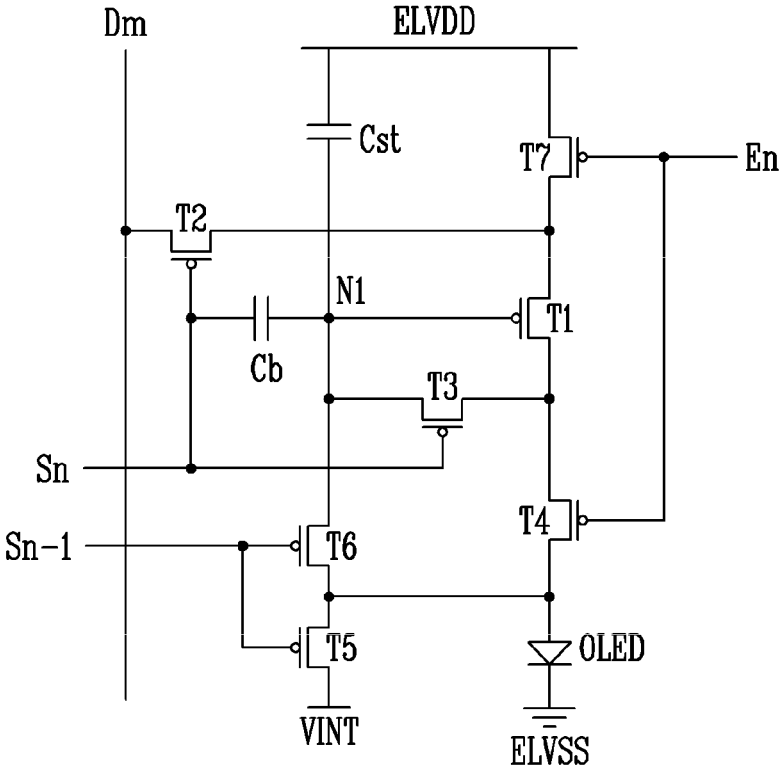
FIG. 2 is a circuit view showing pixels of an organic light emitting display device according to an embodiment of the present invention.

FIG. 2 is a circuit view showing pixels of an organic light emitting display device according to an embodiment of the present invention. For convenience, FIG. 2 shows that the pixel is arranged at n-th (here, n is a natural number) horizontal line and connected to m-th data line Dm.

Referring to FIG. 2, the pixel of the organic light emitting display device according to an embodiment of the present invention includes the organic light emitting diode (OLED) connected between the first power supply supplying a first power (ELVDD) and the second power supply supplying a second power (ELVSS), a first transistor T1 connected between the first power supply supplying the first power (ELVDD) and the organic light emitting diode (OLED), a second transistor T2 connected between a first electrode of the first transistor T1 and the data line Dm, a third transistor T3 connected between a second electrode and a gate electrode of the first transistor T1, a fourth transistor T4 connected between the second electrode of the first transistor T1 and the organic light emitting diode (OLED), a fifth transistor T5 connected between the second electrode of the fourth transistor T4 and a connecting node of the organic light emitting diode (OLED) and the third power supply supplying a third power (VINT) as the initialization power supply, a sixth transistor T6 connected between a first node N1 connected with the gate electrode of the first transistor T1 and the first electrode of the fifth transistor T5, a seventh transistor T7 connected between the first power supply supplying the first power (ELVDD) and the first electrode of the first transistor T1, a storage capacitor Cst connected between the first power supply supplying the first power (ELVDD) and the first node N1, and a boosting capacitor Cb connected between the current scanning line Sn and the first node N1. For this configuration, the fifth and the sixth transistors T5, T6 are connected in series between the first node N1 and the third power supply supplying the third power (VINT) in a dual form.

The first electrode of the first transistor T1 is connected to the first power supply supplying the first power (ELVDD) via the seventh transistor T7, and the second electrode is connected to the organic light emitting diode (OLED) via the fourth transistor T4. In this configuration, the first electrode and the second electrode of the first transistor T1 are different electrodes, and for example, when the first electrode is a source electrode, the second electrode is a drain electrode. In addition, the gate electrode of the first transistor T1 is connected to the first node N1.

The above-mentioned first transistor T1 controls a driving current that is supplied to the organic light emitting diode (OLED), corresponding to voltage of the first node N1, and functions as a driving transistor of pixels.

The first electrode of the second transistor T2 is connected to the data line Dm, and the second electrode of the second transistor T2 is connected to the first electrode of the first transistor T1. Especially, the second electrode of the second transistor T2 is connected to the first node N1 via the first and third transistors T1, T3 when the first and the third transistors T1, T3 are turned on. In addition, the gate electrode of the second transistor T2 is connected to the current scanning line Sn.

The second transistor T2 is turned on when the current scanning signal is supplied from the current scanning line Sn, and then delivers the data signal supplied from the data line Dm to the pixels.

The first electrode of the third transistor T3 is connected to the second electrode of the first transistor T1, and the second electrode of the third transistor T3 is connected to the first node N1 connected with the gate electrode of the first transistor T1. In addition, the gate electrode of the third transistor T3 is connected to the current scanning line Sn.

The third transistor T3 is turned on when the current scanning signal is supplied from the current scanning line Sn and then allows the first transistor T1 to be connected in a diode form.

The first electrode of the fourth transistor T4 is connected to the second electrode of the first transistor T1, and the second electrode of the fourth transistor T4 is connected to an anode electrode of the organic light emitting diode (OLED). In addition, the gate electrode of the fourth transistor T4 is connected to the light emitting control line En.

The fourth transistor T4 is turned on or off according to the light emitting control signal supplied from the light emitting control line En such that the fourth transistor T4 forms a current path or blocks the formation of the current path in the pixels.

The first electrode of the fifth transistor T5 is connected to the connecting node of the organic light emitting diode (OLED) and the fourth transistor T4, and the second electrode of the fifth transistor T5 is connected to the third power supply supplying the third power (VINT). In addition, the gate electrode of the fifth transistor T5 is connected to the previous scanning line Sn−1. The above-mentioned fifth transistor T5 is turned on when the previous scanning signal is supplied from the previous scanning signal line Sn−1 such that the fifth transistor T5 allows the second electrode of the fourth transistor T4 to be connected to the third power supply supplying the third power (VINT).

The first electrode of the sixth transistor T6 is connected to the first node N1, and the second electrode of the sixth transistor T6 is connected to the first electrode of the fifth transistor T5. In addition, the gate electrode of the sixth transistor T6 is connected to the previous scanning line Sn−1.

That is, the fifth transistor T5 and the sixth transistor T6 are connected in the dual form between the first node N1 and the third power supply (VINT) and are turned on together when the previous scanning signal is supplied to the previous scanning line Sn−1.

When the above-mentioned fifth transistor T5 and the sixth transistor T6 are turned on, the voltage of the third power supply supplying the third power (VINT) is supplied to the first node N1 so that the first node N1 is initialized.

The first electrode of the seventh transistor T7 is connected to the first power supply supplying the first power (ELVDD) and the second electrode of the seventh transistor T7 is connected to the first electrode of the first transistor T1. In addition, the gate electrode of the seventh transistor T7 is connected to the light emitting control line En.

The seventh transistor T7 is turned on according to the light emitting signal supplied from the light emitting control line En, and forms the current path or blocks the formation of the current path in the pixels.

The storage capacitor Cst is connected between the first power supply supplying the first power (ELVDD) and the first node N1, and is charged with the voltage corresponding to the voltage supplied to the first node N1.

The boosting capacitor Cb is connected between the current scanning line Sn and the first node N1, and the voltage of the present scanning signal supplied from the present scanning line Sn is changed, so that the boosting capacitor Cb allows the voltage of the first node N1 to be changed by a coupling effect.

However, the connecting node of the fifth transistor T5 and the sixth transistor T6 is connected to the connecting node between the fourth transistor T4 and the organic light emitting diode (OLED).

In addition, during the first period among the initialization period that is supplied with the previous scanning signal to the previous scanning line Sn−1, the light emitting control signal that allows the fourth transistor T4 and the seventh transistor T7 to be turned on is supplied.

Accordingly, during the first period among the initialization period, the current path is formed, in which the current path heads toward the third power supply supplying the third power (VINT) from the first power supply supplying the first power (ELVDD) via the seventh transistor T7, the first transistor T1, the fourth transistor T4, and the fifth transistor T5.

In other words, in the pixels according to an aspect of the present invention, the decrease of the response time due to the hysteresis of the driving transistor is prevented by allowing the fixed current to flow to the first transistor T1 before a data programming period and a light emitting period.

That is, when the pixels display a high luminance (such as, a white) after displaying a low luminance (such as, a black), the response time of the pixels can be improved by expressing the target luminance value at the beginning period for displaying the high luminance. This is done by the flow of the fixed current for compensating the hysteresis of the first transistor T1 during the initialization period before the data programming period and the light emitting period for displaying the high luminance.

As described above, according to an aspect of the present invention, the pixels are initialized by using the fifth transistor T5 and the sixth transistor T6 that are connected in series in the dual form between the third power supply supplying the third power (VINT) and the gate electrode of the first transistor T1, i.e., the driving transistor, but the connecting node of the fifth transistor T5 and the sixth transistor T6 are connected to the connecting node between the organic light emitting diode (OLED) and the fourth transistor T4 for controlling the light emitting between the first transistor T1 and the organic light emitting diode (OLED).

In addition, during the first period among the initialization period for supplying the previous scanning signal to the previous scanning line Sn−1, the current path makes a detour around the third power supply supplying the third power (VINT) and the fifth transistor T5, that is connected in series to the organic light emitting diode (OLED), from the first power supply supplying the first power (ELVDD) via the first transistor T1.

Accordingly, during the initialization period, the increase of the black luminance can be prevented by preventing the light emitting of the organic light emitting diode (OLED), and the decrease of the response time due to the hysteresis of the first transistor T1 can be improved.

Figure 3:
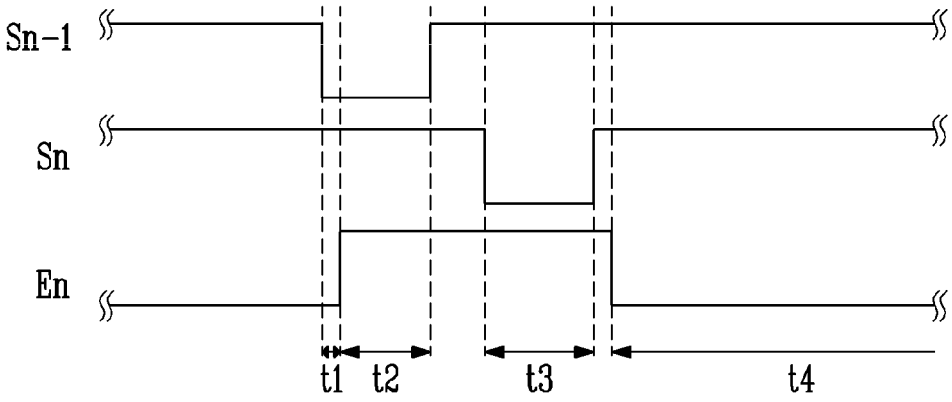
FIG. 3 is a waveform view showing driving signals for driving pixels as depicted in FIG. 2.

FIG. 3 is a waveform view showing driving signals for driving pixels as depicted in FIG. 2. Referring to FIG. 3, the previous scanning signal and the current scanning signal are sequentially supplied to the previous scanning line Sn−1 and the current scanning line Sn. In this configuration, the previous scanning signal and the current scanning signal are set as the voltage that can turn on the transistor included in the pixels, especially, the second and the third transistors T2, T3, and the fifth and the sixth transistors T5, T6 in FIG. 2.

In addition, the light emitting control signal that is supplied to the light emitting control line En is set as the voltage (for example, a low voltage) that can turn on the transistor included in the pixels, especially, the fourth and the seventh transistors T4, T7 in FIG. 2. Also, the light emitting control signal that is supplied to the light emitting control line En is set as the voltage (for example, a high voltage) that can turn on the fourth and the seventh transistors T4, T7 during the third period t3 for supplying the current scanning signal from the second period t2 after the remained period of the initialization period (i.e., the first period t1). And then the light emitting control signal is set as the voltage that can turn on the fourth and the seventh transistors T4, T7 during the fourth period t4, i.e., the light emitting period after completely supplying the current scanning signal.

In other words, the light emitting signal of a high voltage that can turn on the fourth and the seventh transistor T4, T7 is supplied and maintained until the supply of the present scanning signal is finished during the period of supplying the previous scanning signal.

The driving process of the pixels according to the driving signals of FIG. 3 will be described in more detail as follows with reference to FIG. 4A to FIG. 4D.

Figure 4A:
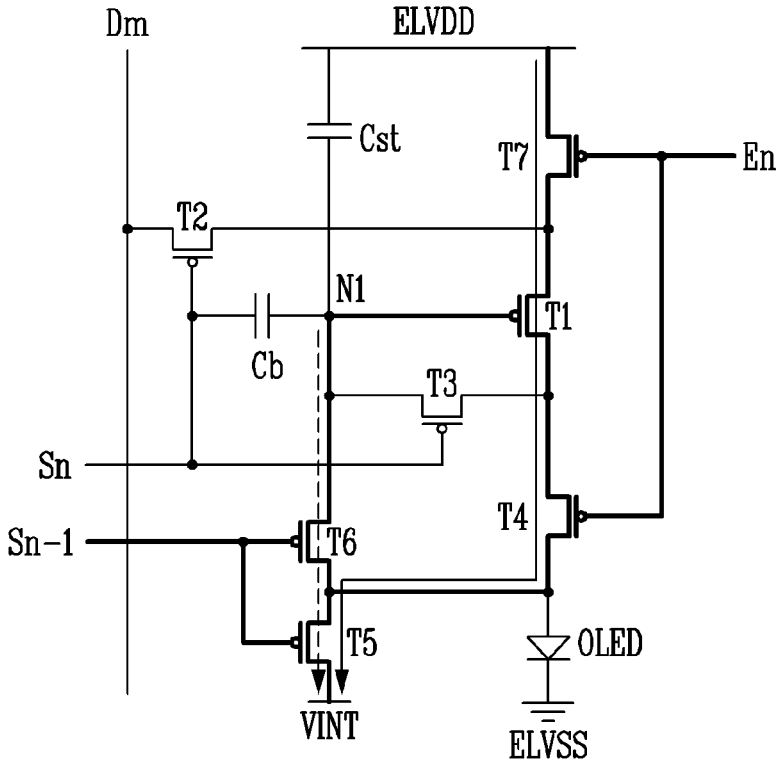
FIG. 4A to FIG. 4H are circuit views and waveform views showing successively a method for driving pixels of FIG. 2 that are implemented by driving signals of FIG. 3.
Figure 4B:
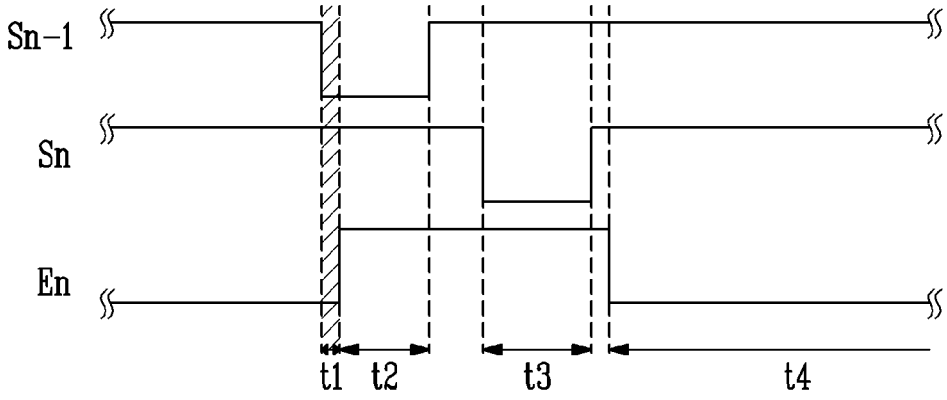

FIG. 4A to FIG. 4H are circuit views and waveform views showing successively a method for driving pixels of FIG. 2 that are implemented by driving signals of FIG. 3. Referring to FIGS. 4A and 4B, the light emitting control signal of the low voltage is supplied to the light emitting control line En during the first period t1 among the initialization period t1, t2 for supplying the previous scanning signal to the previous scanning line Sn−1.

When the pervious scanning signal of the low voltage is supplied to the previous scanning line Sn−1, the fifth and the sixth transistor T5, T6 are turned on, and then the voltage of the third power supply supplying the third power (VINT) is delivered to the first node N1 (the arrow direction in FIG. 4A is shown considering the voltage of the first node N1 having a higher voltage than the voltage of the third power supply supplying the third power (VINT) before the first period t1).

With this configuration, the voltage of the third power supply supplying the third power (VINT) may be set as the sufficiently low voltage that can initialize the first node N1, i.e., above a threshold voltage of the first transistor T1 rather than the lowest voltage (the highest gradation voltage when the driving transistor is a PMOS transistor) among a gradation voltage of the data signal. Therefore, during the data programming period t3 after the above period, the data signal is supplied to the first node N1 via the first transistor T1 and the third transistor T3 by forward connecting the first transistor T1 to the diode.

The embodiment using the special third power supply supplying the third power (VINT) as the initialization power supply described above is not limited thereto, and other power supplies may be used as the initialization power supply. For example, the second electrode of the fifth transistor T5 may be connected to the second power supply supplying the second power (ELVSS), and can use the second power (ELVSS) as the initialization power.

The voltage of the third power supply supplying the third power (VINT) is set as the low voltage, and the first transistor T1 is also turned on during the initialization period t1 to t2 for supplying the previous scanning signal to the previous scanning line Sn−1.

Meanwhile, when the light emitting control signal of the low voltage is supplied to the light emitting control line En, the fourth and the seventh transistors T4, T7 are turned on.

Therefore, during the first period t1, the voltage of the third power supply supplying the third power (VINT) is supplied to the first node N1, and the current path that flows from the first power supply supplying the first power (ELVDD) to the third power supply supplying the third power (VINT) via the seventh transistor T7, the first transistor T1, the fourth transistor T4, and the fifth transistor T5 is formed.

Accordingly, the fixed current flows to the first transistor T1 so that the hysteresis of the first transistor T1 is compensated, and also the current flows through a detour to the fifth transistor T5 from the fourth transistor T4, so that the increase of the black luminance is prevented by preventing the emitting of light of the organic light emitting diode (OLED).

In other words, the first period t1 is the period for improving the response time by preventing the decrease of the response time due to the hysteresis of the first transistor T1 by having the fixed current flow to the first transistor T1. Especially, there is an advantage that the black is clearly displayed by preventing the emission of light of the organic light emitting diode (OLED) during the above-mentioned period.

Figure 4C:
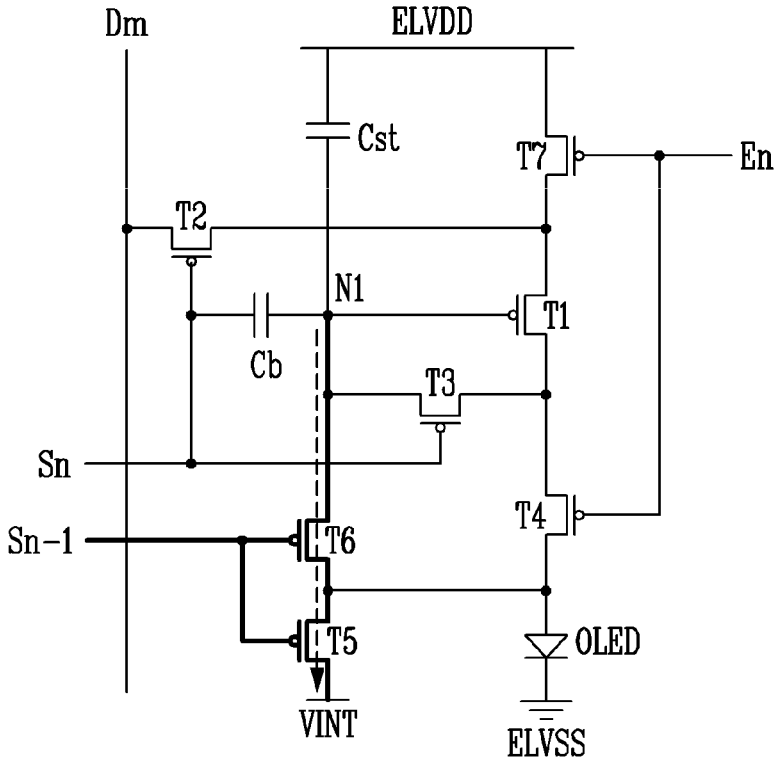
Figure 4D:
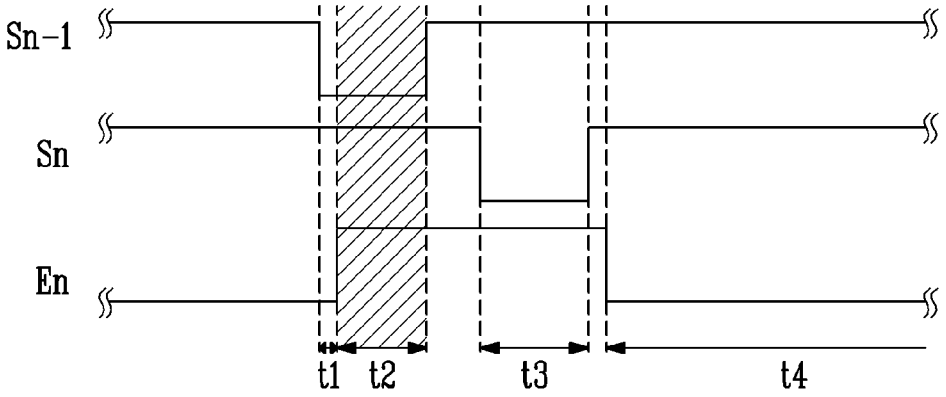

Hereinafter, as depicted in FIGS. 4C and 4D, the voltage of the light emitting control signal that is supplied to the light emitting control line En is changed to the high voltage during the second period t2 after the first period t1 among the initialization period t1, t2.

That is, during the second period t2, the supply of the previous scanning signal of the low voltage is maintained in the previous scanning line Sn−1, and also the light emitting control signal of the high voltage is supplied to the light emitting control line En.

When the light emitting control signal of the high voltage is supplied to the light emitting control line En, the fourth and the seventh transistors T4, T7 are turned off, and then the current flowing via the first transistor T1 is blocked during the first period t1.

In addition, because the previous scanning signal of the low voltage is maintained during the second period t2 like the first period t1, the fifth and the sixth transistors T5, T6 are maintained in the turn-on state, therefore, the first node N1 is initialized with the voltage of the third power supply (VINT).

Figure 4E:
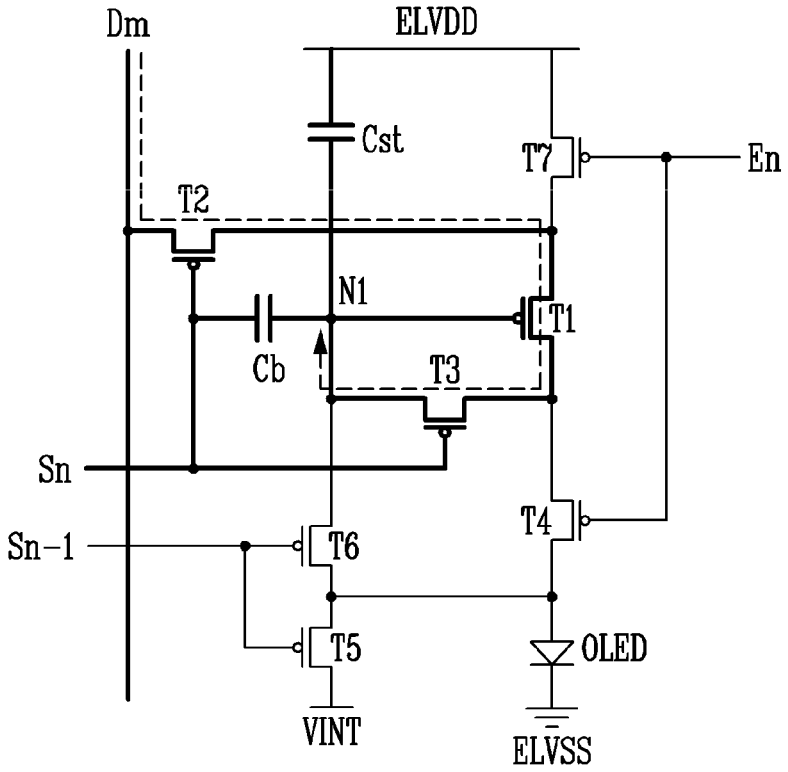
Figure 4F:
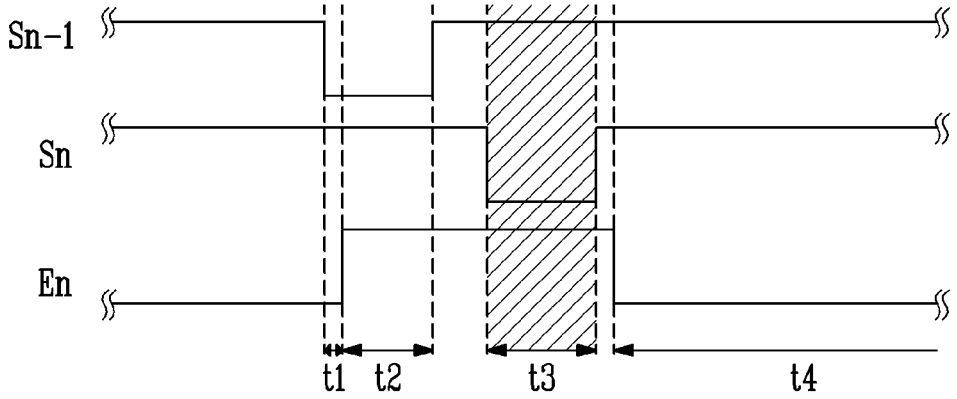

Hereinafter, as depicted in FIGS. 4E and 4F, the current scanning signal of the low voltage is supplied to the current scanning line Sn during the third period t3.

Thereafter, the second and the third transistors T2, T3 are turned on, and the first transistor T1 is in a diode-connected state by the third transistor T3.

During the above-mentioned third period t3, the data signal is supplied to the data line Dm, and the data signal is delivered to the first node N1 via the second transistor T2, the first transistor T1 and the third transistor T3. In this configuration, the first transistor T1 is in the diode-connected state, so that the different voltage of the threshold voltage of the data signal and the first transistor T1 is delivered to the first node N1.

In other words, the third period t3 is the compensation period of the threshold voltage and the data programming for supplying the voltage corresponding to the threshold voltage of the first transistor T1 and the data signal of the first node N1, and the voltage delivered to the first node N1 during the above-mentioned period is stored in the storage capacitor Cst and the boosting capacitor Cb.

Thereafter, when the voltage of the present scanning signal supplied to the present scanning line Sn along with the end of the third period t3, the voltage of the first node N1 is slightly increased by the coupling effect of the boosting capacitor Cb. In other words, the boosting capacitor Cb has the function of boosting the voltage of the first node N1, so that the black luminance can be improved by including the boosting capacitor Cb.

Figure 4G:
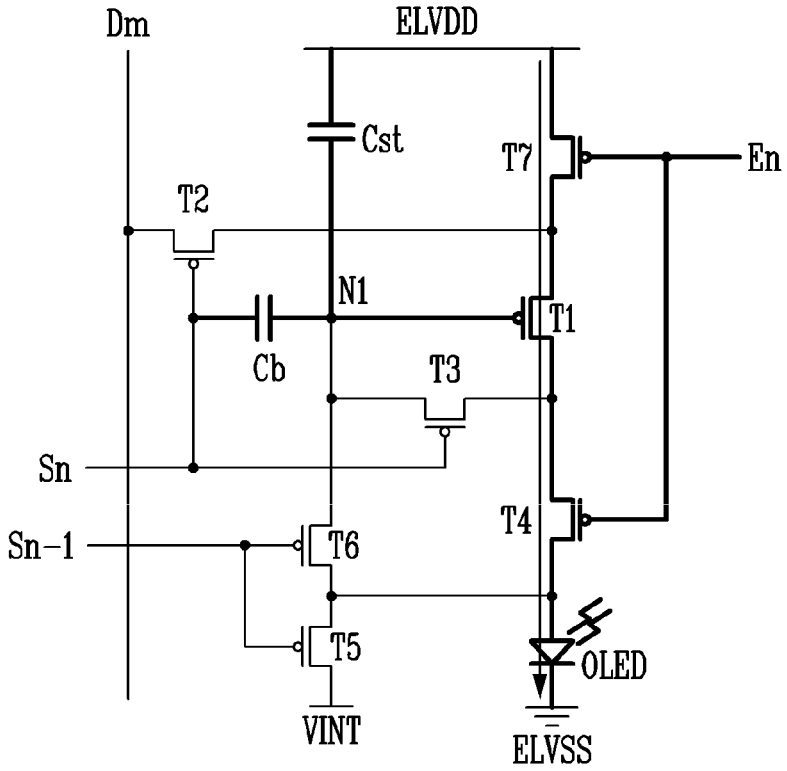
Figure 4H:
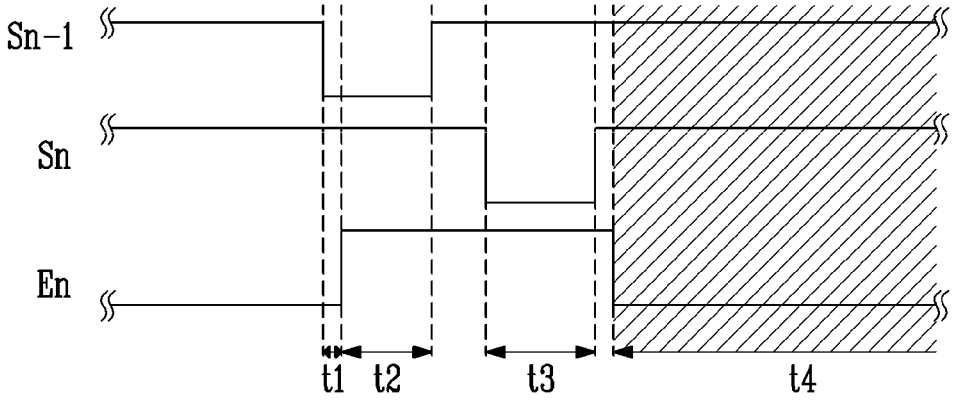

After completely supplying the present scanning signal to the current scanning line Sn, the light emitting control signal of the low voltage is supplied to the light emitting control line En during the fourth period t4 as depicted in FIGS. 4G and 4H.

Accordingly, the fourth and seventh transistors T4, T7 are turned on, the driving current flows to the second power supply supplying the second power (ELVSS) from the first power supply supplying the first power (ELVDD) via the seventh transistor T7, the first transistor T1, the fourth transistor T4, and the organic light emitting diode (OLED).

In this configuration, the driving current is controlled by the first transistor T1 corresponding to the voltage of the first node N1, and the voltage of the data signal and also the voltage corresponding to the threshold voltage of the first transistor T1 are stored in the first node N1 during the previous third period t3, so that the threshold voltage of the first transistor T1 is offset during the fourth period t4, and then is uniformly set corresponding to the data signal unrelated to the deviation of the threshold voltage of the first transistor T1.

In other words, the fourth period t4 is the light emitting period of the pixels, and the organic light emitting diode (OLED) emits light as the luminance corresponding to the data signal during the fourth period t4.

Figure 5:
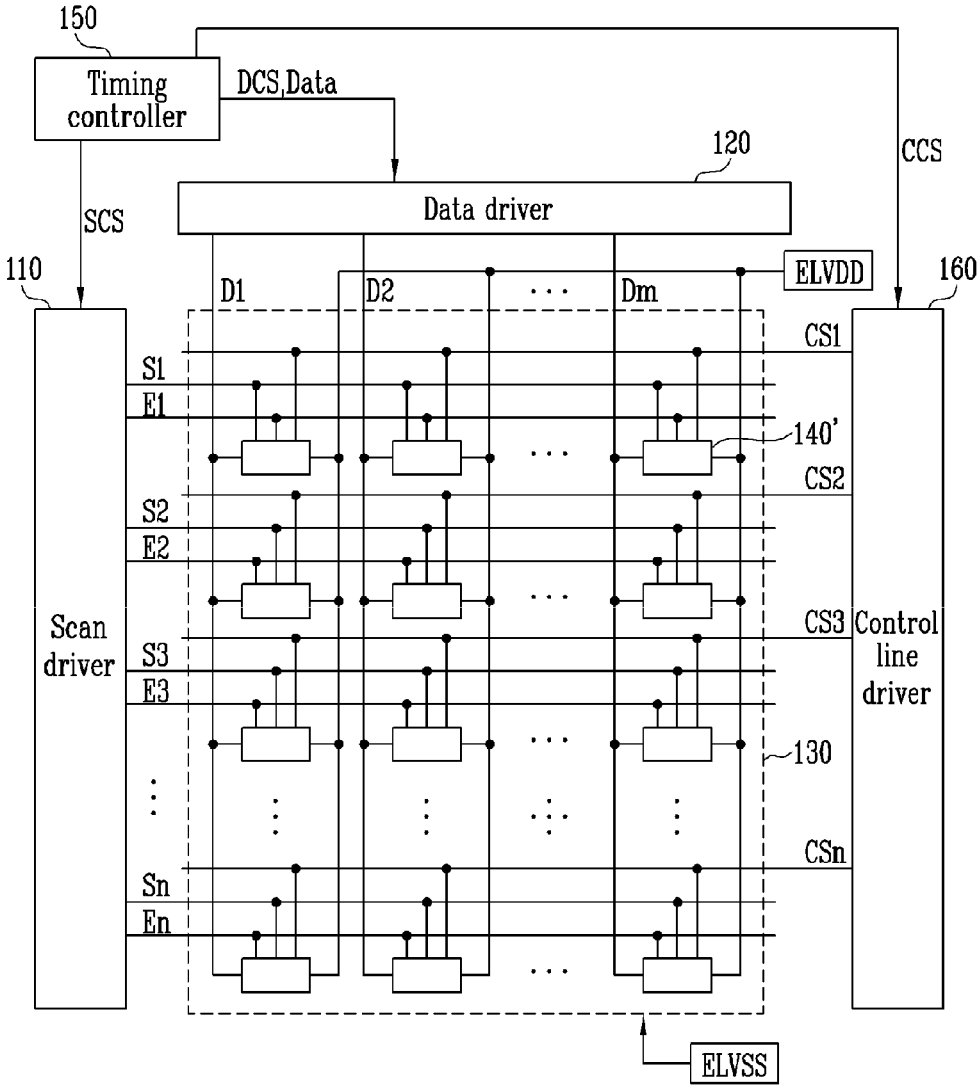
FIG. 5 is a block view showing a structure of an organic light emitting display device according to another embodiment of the present invention.

FIG. 5 is a block view roughly showing a structure of an organic light emitting display device according to another embodiment of the present invention. For convenience, when describing FIG. 5, the descriptions about the same parts or similar parts to FIG. 1 will not be provided.

Referring to FIG. 5, the organic light emitting display device further includes the control lines CS1 to CSn aligned with the scanning lines S1 to Sn, and the control line driver 160 for driving the control lines CS1 to CSn.

The control line driver 160 generates the control signal by being supplied with the control line driving control signal (CCS) from the timing controller 150, and sequentially supplies the generated control signal to the control lines CS1 to CSn.

In other words, each pixel 140' is driven by being further supplied with the control signal from the control lines CS1 to CSn in the organic light emitting display device. For example, each control line CS1 to CSn is connected to the gate electrode of the third and the fifth transistors in the pixels 140', so that they can control on/off of the third and the fifth transistors.

However, in the embodiment of the present invention according to FIG. 5, the control line driver 160 starts to supply the control lines CS1 to CSn with the control signals that can turn on the fixed transistors (third and fifth transistors) connected to the pixels 140' before the scanning period that is supplied with the current scanning signal to the current scanning line S connected to the pixels 140' based on the pixels 140' supplied with the scanning signal, maintains the supply of the control signal until finishing the supply of the current scanning signal, and then stops the supply of the control signal after supplying the current scanning signal.

Meanwhile, FIG. 5 shows the control line driver 160 as a special component different from the scanning driver 110, but the aspects of the present invention are not limited thereto. For example, it can be possible that the circuit for producing the control signal can be included in the scanning driver 110.

In addition, the scanning driver 110 supplies the scanning signal to the scanning lines S1 to Sn to be turned on the fixed transistors (second transistors) included in the pixels 140' during the supply of the control signal to the control line CS based on each pixel 140'.

In this configuration, the scanning signal is supplied after the fixed time after starting the supply of the control signal.

In addition, the scanning driver 110 supplies the light emitting control signal to the light emitting control lines E1 to En to be turned on the fixed transistors (fourth and seventh transistors) included in the pixels 140' during the initial period before supplying the scanning signal during the period for supplying the control signal.

After, the scanning driver 110 stops the supply of the light emitting control signal to turn on the fixed transistors (fourth and seventh transistors) included in the pixels 140' before starting the supply of the scanning signal, and then continuously supplies the light emitting signal that can turn on the fixed transistors, and then again supplies the light emitting control signal to turn on the fixed transistors after completely supplying the scanning signal and the control signal.

The above-mentioned examples of the pixels 140' applicable to the organic light emitting display device will be described with reference to FIG. 6 to FIG. 10.

Figure 6:
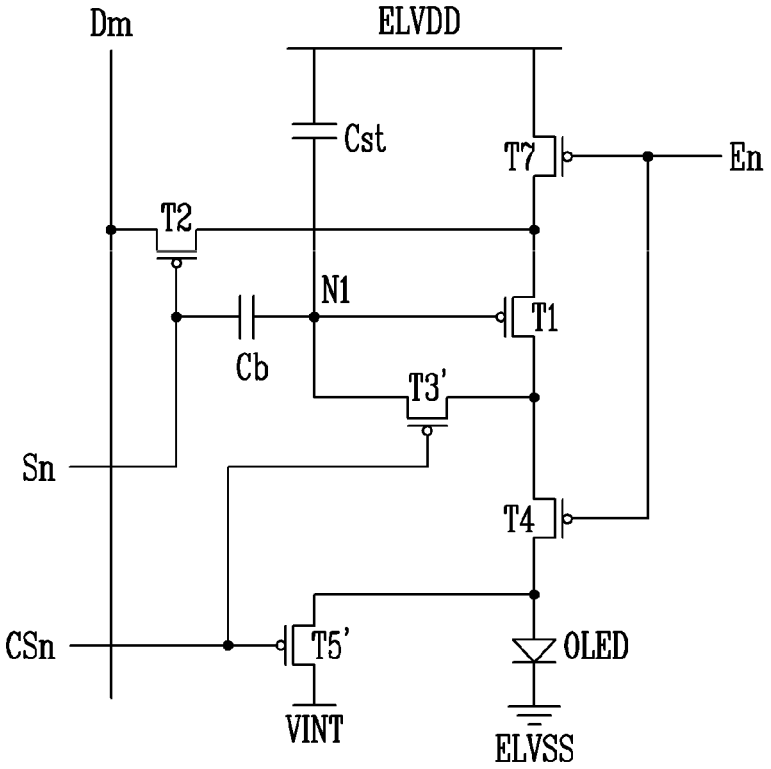
FIG. 6 is a circuit view showing pixels of an organic light emitting display device according to another embodiment of the present invention.
Figure 7:
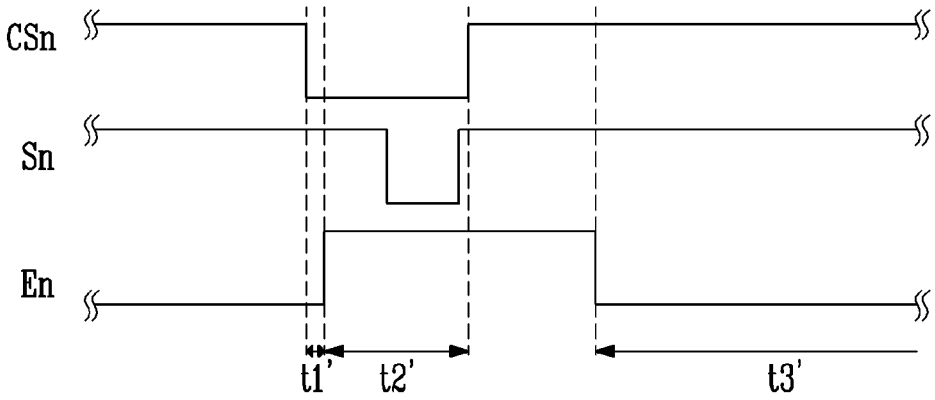
FIG. 7 is a waveform view showing driving signals for driving pixels as depicted in FIG. 6.

FIG. 6 is a circuit view showing pixels of an organic light emitting display device according to another embodiment of the present invention. FIG. 7 is a waveform view showing driving signals for driving pixels as depicted in FIG. 6. For convenience, when describing FIG. 6 and FIG. 7, the overlap description about the same parts or similar parts with FIG. 2 and FIG. 3 will not be provided.

Referring to FIG. 6, in the pixels of the organic light emitting display device, the gate electrode of the third transistor T3' and the fifth transistor T5' is connected to the control line CSn, and the sixth transistor T6 of FIG. 2 is not provided.

In this configuration, as depicted in FIG. 7, the control signal that can turn on the third and the fifth transistor T3', T5' is supplied from the control line CSn during the first period t1' to the second period t2', and the scanning signal that can turn on the second transistor T2 is supplied from the current scanning line Sn during the second period t2'.

In addition, the light emitting control signal that can turn on the fourth and the seventh transistors T4, T7 is supplied from the light emitting control line En during the first period t1'. Thereafter the light emitting control signal that can turn off the fourth and the seventh transistors T4, T7 is supplied until from the beginning of the third period t3'. After that, the light emitting control signal that can turn on the fourth and the seventh transistors T4, T7 is again supplied during the third period t3' as the light emitting period.

The driving method of the pixels according to the embodiment of the present invention will be described with reference to FIGS. 8A to 8F.

FIGS. 8A to 8F are circuit views and waveform views showing successively a method for driving pixels of FIG. 6 that are implemented by driving signals of FIG. 7. When describing FIGS. 8A to FIG. 8F, the detail description about the same parts or the similar parts with reference to FIG. 4A to FIG. 4H will not be provided.

Figure 8A:
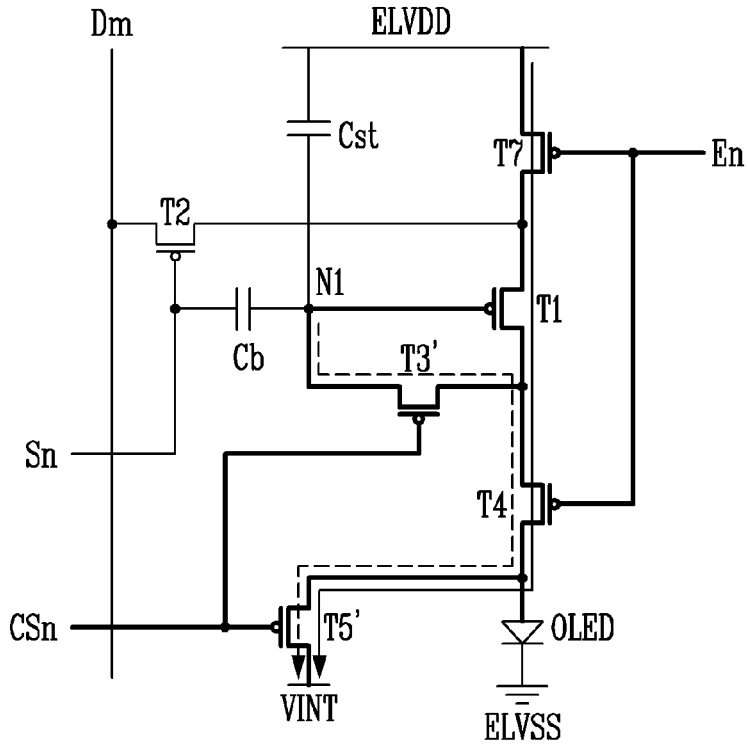
FIG. 8A to FIG. 8F are circuit views and waveform views showing successively a method for driving pixels of FIG. 6 that are implemented by driving signals of FIG. 7.
Figure 8B:
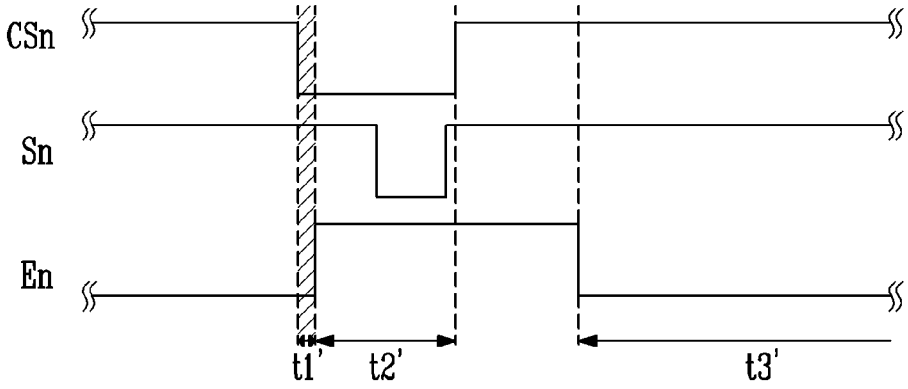

Referring to FIGS. 8A and 8B, the control signal and the light emitting control signal of the low voltage are supplied from the control line CSn and the light emitting control line En during the first period t1', respectively.

When the control signal of the low voltage is supplied to the control line CSn, the third and the fifth transistors T3', T5' are turned on, and when the light emitting control signal of the low voltage is supplied to the light emitting control line En, the fourth and the seventh transistors T4, T7 are turned on.

Therefore, the voltage of the third power supply supplying the third power (VINT) is supplied to the first node N1 during the first period t1', and also the current path toward the third power supply supplying the third power (VINT) from the first power supply supplying the first power (ELVDD) via the seventh transistor T7, the first transistor T1, the fourth transistor T4, and the fifth transistor T5' is formed.

Accordingly, the fixed current flows to the first transistor T1, the hysteresis of the first transistor T1 is compensated, and the current also flows along a detour onto the fifth transistor T5' from the fourth transistor T4, thereby preventing an increase of the black luminance by preventing the emission of light from the organic light emitting diode (OLED).

In other words, the first period t1' allows the response time to be improved by having the fixed current flow to the first transistor T1, and also the first node N1 to be initialized to the third power supply supplying the third power (VINT), so that the first period t1' is the period for improving the response time and initialization. During the above-mentioned period, black can be clearly displayed by preventing the emission of light from the organic light emitting diode (OLED).

Figure 8C:
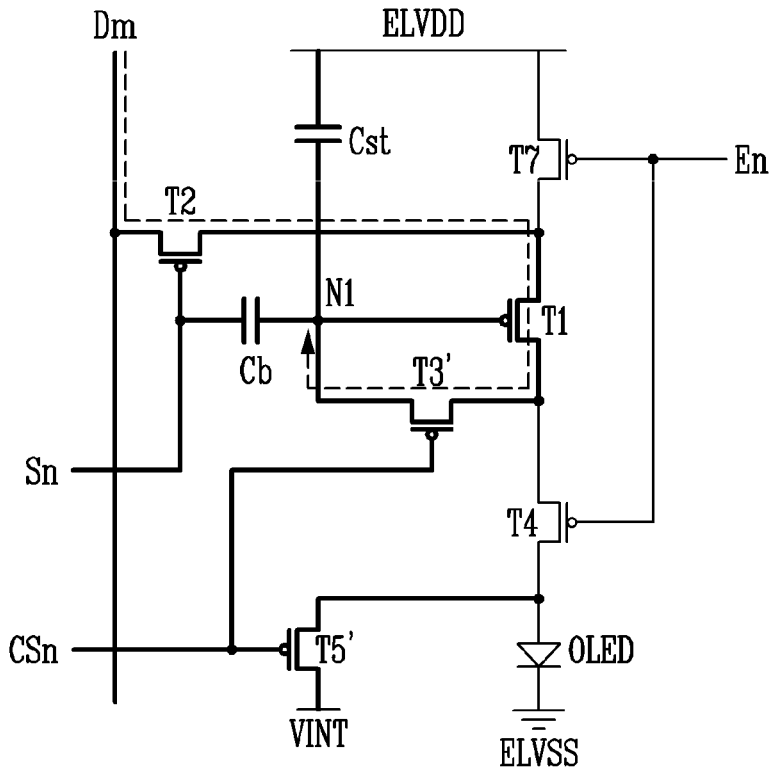
Figure 8D:
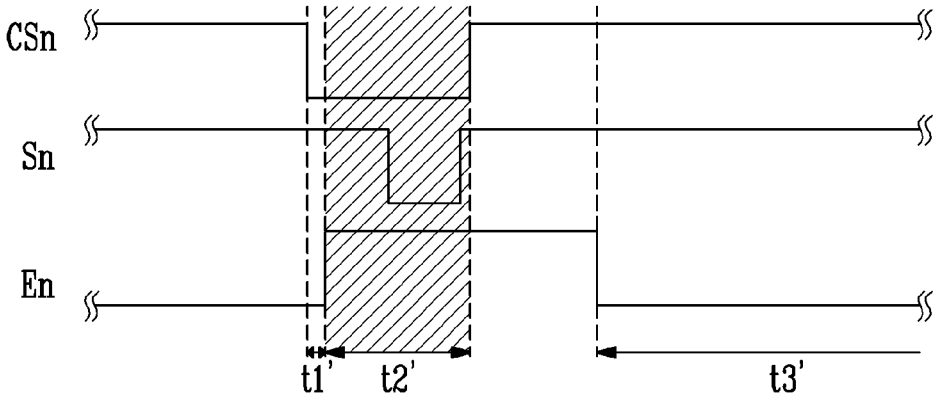

As depicted in FIGS. 8C and 8D, during the second period t2' after the first period t1', the control signal of the low voltage is continuously supplied to the control line CSn, and also the light emitting control signal of the high voltage is supplied to the light emitting control line En.

Therefore, during the second period t2', the third and the fifth transistors T3', T5' are maintained on the turn-on state, and the fourth and the seventh transistors T4, T7 are turned off.

In addition, during the above-mentioned second period t2', the current scanning signal of the low voltage is supplied to the current scanning line Sn, so that the second transistor T2 is turned on.

Meanwhile, during the above-mentioned second period t2', the data signal is supplied to the data line Dm. In this configuration, during the second period t2', each data line can be charged in advance with the data signal to supply the data signal. To achieve this, for example the data signal can be supplied in advance from the data driver to each data line before supplying the scanning signal among the first and second period t1', t2'. In other words, a demux time can be set for overlapping the initial period of the second period t2' along with the first period t1' (not shown in the figures).

When the second transistor T2 is turned on during the second period t2', the data signal from the data line Dm is delivered to the first node N1 via the second transistor T2, the first transistor T1, and the third transistor T3'. In this configuration, the first transistor T1 is in the diode-connected state, so that the different voltage of the threshold voltage of the first transistor T1 and the data signal is delivered to the first node N1.

In other words, the second period t2' is the data programming and the threshold voltage compensation period, in which the voltage corresponding to the threshold voltage of the first transistor T1 and the data signal are supplied to the first node N1. During the above-mentioned second period t2', the voltage delivered to the first node N1 is stored in the storage capacitor Cst and the boosting capacitor Cb.

Figure 8E:
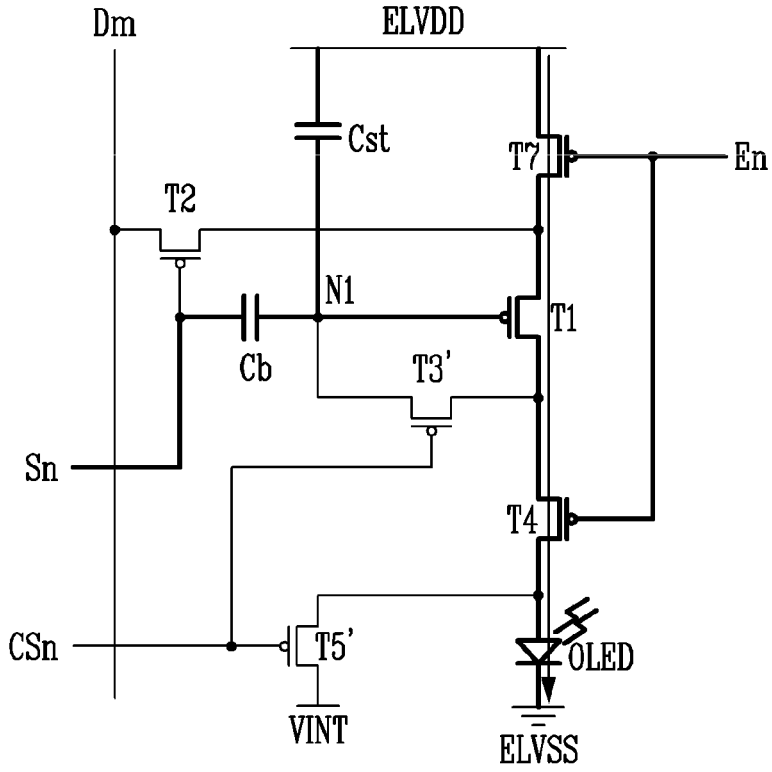
Figure 8F:
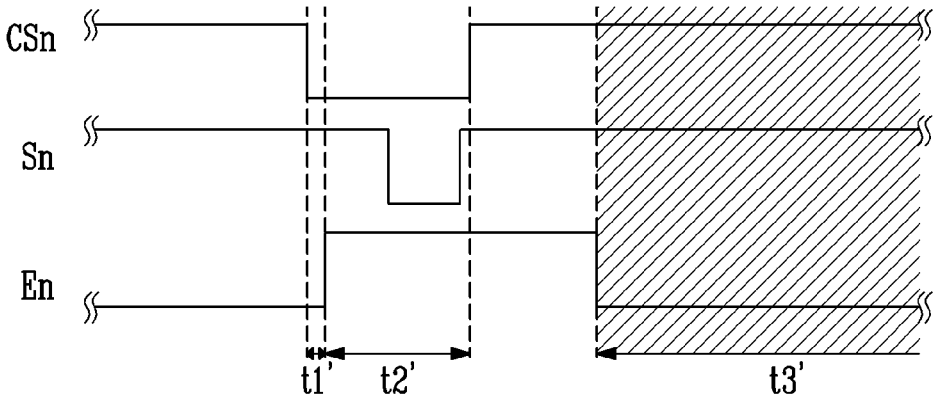

After the fixed time from the point for completing the supply of the present scanning signal to the present scanning line Sn, the light emitting control signal of the low voltage is supplied to the light emitting control line En during the third period t3' as depicted in FIGS. 8E and 8F.

Accordingly, during the third period t3', the fourth and the seventh transistors T4, T7 are turned on, so that the driving current flows from the first power supply supplying the first power (ELVDD) to the second power supply supplying the second power (ELVSS) via the seventh transistor T7, the first transistor T1, the fourth transistor T4, and the organic light emitting diode (OLED).

In other words, the third period t3' is the limit emitting period of the pixels, and the organic light emitting diode (OLED) is light-emitted as the luminance corresponding to the data signal during the third period t3'.

Figure 9:
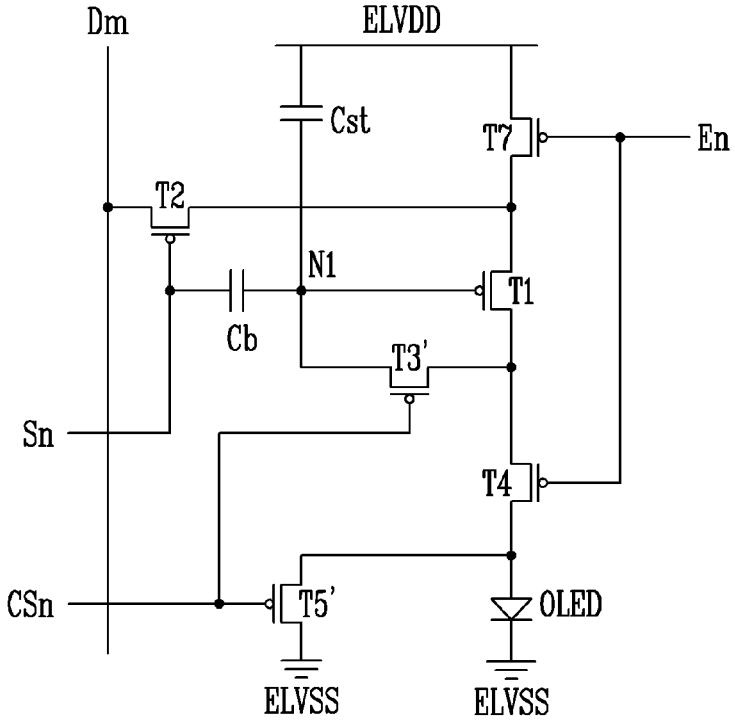
FIG. 9 is a circuit view showing pixels of an organic light emitting display device according another embodiment of the present invention.
Figure 10:
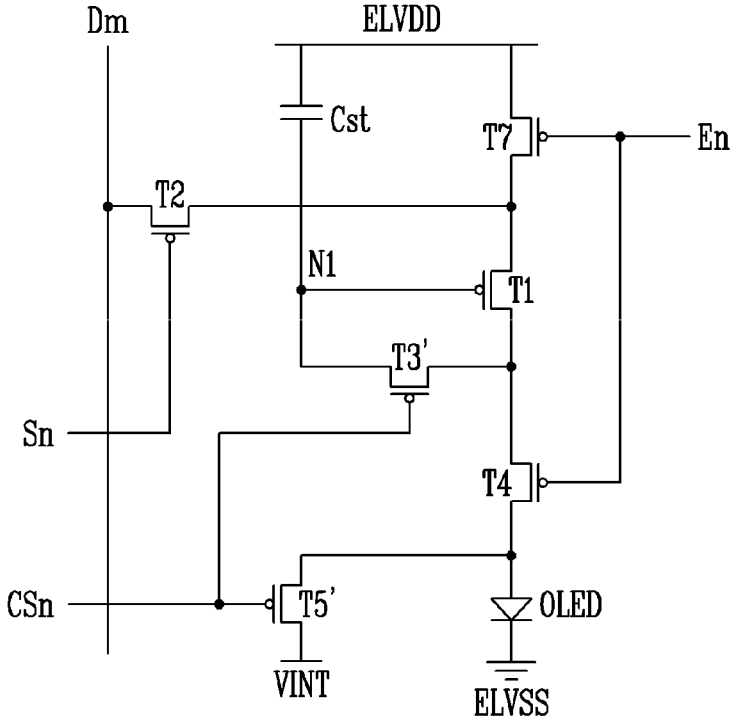
FIG. 10 is a circuit view showing pixels of an organic light emitting display device according another embodiment of the present invention.

FIG. 9 and FIG. 10 are circuit views showing pixels of an organic light emitting display device according another embodiment of the present invention. When describing FIG. 9 and FIG. 10, the detail description about the same parts or similar parts with reference to FIG. 6 will not be provided.

Referring to FIG. 9, the fifth transistor T5' is connected to the second power supply supplying the second power (ELVSS) instead of the third power supply supplying the third power (VINT). Therefore, the first node N1 is initialized by the voltage of the second power supply supplying the second power (ELVSS) during the initialization period.

In addition, referring to FIG. 10, the boosting capacitor Cb can be omitted. In other words, the boosting capacitor Cb is not always included for implementing the embodiments of the present invention, and can be optionally included according to the object of the planning.

While the aspects of the present invention have been described in connection with certain exemplary embodiments, it is to be understood that the invention is not limited to the disclosed embodiments, but, on the contrary, is intended to cover various modifications and equivalent arrangements included within the spirit and scope of the appended claims, and -equivalents thereof.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A pixel comprising:

an organic light emitting diode connected between a first power supply that is a high potential pixel power supply and a second power supply that is a low potential pixel power supply;

a first transistor connected between the first power supply and the organic light emitting diode, in which a gate electrode of the first transistor is connected to a first node;

a second transistor connected between a first electrode of the first transistor connected to the first power supply and a data line, in which a gate electrode of the second transistor is connected to a current scanning line;

a third transistor connected between a second electrode of the first transistor connected to the organic light emitting diode and the first node, in which a gate electrode of the third transistor is connected to the current scanning line;

a fourth transistor connected between the second electrode of the first transistor and the organic light emitting diode, in which a gate electrode of the fourth transistor is connected to a light emitting control line;

a fifth transistor comprising a first electrode directly connected to a connecting node located between the fourth transistor and the organic light emitting diode, and a second electrode directly connected to the second power supply or a third power supply that is an initialization power supply, in which a gate electrode of the fifth transistor is connected to a previous scanning line;

a sixth transistor between the first node and the first electrode of the fifth transistor and configured to directly electrically couple the first node to the first electrode of the fifth transistor in response to a previous scanning signal applied to the previous scanning line; and a storage capacitor connected between the first power supply and the first node.

2. The pixel as claimed in claim 1, further comprising the sixth transistor connected between the first electrode of the fifth transistor connected to the connecting node of the fourth transistor and the organic light emitting diode, and the first node, wherein the gate electrode of the fifth transistor and the gate electrode of the sixth transistor are mutually connected to the previous scanning line.

3. The pixel as claimed in claim 2, wherein the fifth transistor and the sixth transistor are turned on during an initialization period for supplying the previous scanning signal to the previous scanning line, so that voltage of the second power supply or the third power supply is applied to the first node; and the fourth transistor is turned on by a light emitting control signal supplied to the light emitting control line during a first period among the initialization period.

4. The pixel as claimed in claim 3, wherein a current path formed during the first period among the initialization period flows from the first power supply to the second power supply or the third power supply via the first transistor, the fourth transistor and the fifth transistor.

5. The pixel as claimed in claim 3, wherein the fourth transistor is turned off by the light emitting control signal during a second period after the first period among the initialization period.

6. The pixel as claimed in claim 2, further comprising a seventh transistor connected between the first electrode of the first transistor and the first power supply, wherein a gate electrode of the seventh transistor is connected to the light emitting control line.

7. The pixel as claimed in claim 1, further comprising a boosting capacitor connected between the current scanning line and the first node.

8. An organic light emitting display device comprising:

a scanning driver that sequentially supplies a scanning signal to scanning lines and supplies a light emitting control signal to light emitting control lines that are aligned with the scanning lines; a data driver that supplies a data signal to data lines;

a pixel unit arranged at an intersection of the scanning lines, the light emitting control lines and the data lines, and includes a plurality of pixels supplied with a first power, a high potential pixel power and a second power, a low potential pixel power;

wherein each pixel includes:

an organic light emitting diode connected between a first power supply and a second power supply;

a first transistor connected between the first power supply and the organic light emitting diode, in which a gate electrode of the first transistor is connected to a first node;

a second transistor connected between a first electrode of the first transistor connected to the first power supply and a data line, in which a gate electrode of the second transistor is connected to a current scanning line;

a third transistor connected between a second electrode of the first transistor connected to the organic light emitting diode and the first node, in which a gate electrode of the third transistor is connected to the current scanning line;

a fourth transistor connected between the second electrode of the first transistor and the organic light emitting diode, in which a gate electrode of the fourth transistor is connected to a light emitting control line;

a fifth transistor comprising a first electrode directly connected to a connecting node located between the fourth transistor and the organic light emitting diode, and a second electrode directly connected to the second power supply or a third power supply that is an initialization power supply, in which a gate electrode of the fifth transistor is connected to a previous scanning line;

a sixth transistor between the first node and the first electrode of the fifth transistor and configured to directly electrically couple the first node to the first electrode of the fifth transistor in response to a previous scanning signal applied to the previous scanning line; and a storage capacitor connected between the first power supply and the first node.

9. The organic light emitting display device as claimed in claim 8, further comprising the sixth transistor that is connected between the first electrode of the fifth transistor connected to the connecting node of the fourth transistor and the organic light emitting diode, and the first node, wherein the gate electrode of the fifth transistor and the sixth transistor is mutually connected to the previous scanning line.

10. The organic light emitting display device as claimed in claim 9, wherein the scanning driver supplies the light emitting control signal to the light emitting control line during a first period among the period for supplying a previous scanning signal to the previous scanning line, so as to turn on the fourth transistor.

11. The organic light emitting display device as claimed in claim 10, wherein the scanning driver supplies the light emitting control signal to the light emitting control line during a second period after the first period among the period for supplying the previous scanning signal to the previous scanning line so as to turn off the fourth transistor.

12. The organic light emitting display device as claimed in claim 10, wherein the scanning driver continuously supplies the light emitting control signal, that can turn off the fourth transistor, to the light emitting control line during the period from a second period after the first period to a third period for supplying a current scanning signal to the current scanning line among the period for supplying the previous scanning signal, and then supplies the light emitting control signal that can turn on the fourth transistor to the light emitting control line during a fourth period after the third period.

13. The organic light emitting display device as claimed in claim 8, wherein each pixel further includes a seventh transistor connected between the first electrode of the first transistor and the first power supply, in which a gate electrode of the seventh transistor is connected to the light emitting control line.

14. The organic light emitting display device as claimed in claim 8, wherein each pixel further includes a boosting capacitor connected between the current scanning line and the first node.

* * * * *